United States Patent [19]

Iijima et al.

[11] 4,370,410

[45] Jan. 25, 1983

[54] SILVER HALIDE COLOR PHOTOSENSITIVE MATERIAL

[75] Inventors: Toshifumi Iijima, Kokubunzi; Wataru Fujimatsu, Hachioji; Kaoru Onodera, Odawara, all of Japan

[73] Assignee: Konishiroku Photo Industry Co., Ltd., Japan

[21] Appl. No.: 333,899

[22] Filed: Dec. 23, 1981

[30] Foreign Application Priority Data

Dec. 26, 1980 [JP] Japan ..... 55-187438

[51] Int. Cl.[3] ..... G03C 1/76

[52] U.S. Cl. ..... 430/505; 430/506; 430/509; 430/557

[58] Field of Search ..... 430/503, 505, 506, 509, 430/557

[56] References Cited

U.S. PATENT DOCUMENTS

| | | | |
|---|---|---|---|
| 4,184,876 | 1/1980 | Eeles et al. | 430/506 |
| 4,186,011 | 1/1980 | Lohmann et al. | 430/506 |
| 4,186,016 | 1/1980 | Lohmann et al. | 430/506 |
| 4,267,264 | 5/1981 | Lohmann et al. | 430/505 |
| 4,320,193 | 3/1982 | Robillard | 430/503 |

*Primary Examiner*—J. Travis Brown

*Attorney, Agent, or Firm*—Finnegan, Henderson, Farabow, Garrett & Dunner

[57] ABSTRACT

A silver halide color material comprising red, green and blue photosensitive silver halide emulsion layers, each of which contains a coupler, and in which said green photosensitive layer is composed of at least two layers and between those of which said red photosensitive layer is arranged, and said green photosensitive layer contains an anti-diffusive yellow coupler.

6 Claims, No Drawings

SILVER HALIDE COLOR PHOTOSENSITIVE MATERIAL

The present invention relates to a silver halide color photosensitive material, and more particularly to a silver halide color photosensitive material for taking a photograph to be processed through the negative-positive printing process which is improved in the photographic characteristics such as sensitivity, graininess, gradient, etc.

Heretofore, it has so far been strongly desired to develop the photosensitive materials having a high photosensitivity and fine grains to serve as a color photosensitive material, and there have been proposed a number of improved color photosensitive materials for the purpose.

As for one of the photosensitive materials suitable for the above-mentioned purpose, the example thereof has been given in Japanese Patent Open to Public Inspection No. 49027/1976 describing the multi-layered color photosensitive material in which there is arranged on the support thereof with the low photosensitive emulsion unit comprising both of a lowly green photosensitive silver halide emulsion layer containing magenta couplers and a red photosensitive silver halide photosensitive emulsion layer containing cyan couplers, and there is arranged on the said layer, one upon another, with the highly photosensitive emulsion unit comprising both of a highly green photosensitive silver halide emulsion layer containing magenta couplers and a red photosensitive silver halide emulsion layer containing cyan couplers, and further there is arranged on the said layer with one or more blue photosensitive silver halide emulsion layer containing yellow couplers, through a blue light absorption filter layer.

Further as for the example thereof improved the above-mentioned layer arrangements, the one having the layer arrangement in which the green photosensitive silver halide emulsion layer comprises three layers, has been described in Japanese Patent Open to Public Inspection No. 97424/1978. On the other hand, in U.S. Pat. No. 4,186,016, there has been disclosed the example of the layer arrangement in which both of the highly red photosensitive silver halide emulsion layer and the lowly red photosensitive emulsion layer are arranged between the two green photosensitive silver halide emulsion layers. And as for the characters of the above described color photosensitive material, there has been given the character that the red photosensitive emulsion layer in particular can be highly sensitized in the case that a red photosensitive emulsion layer is arranged between the highly green photosensitive emulsion layer and the lowly green photosensitive emulsion layer.

However in the case of the layer arrangements as described above, there are caused the defects that the amount of light is lowered to reach the lowly green photosensitive emulsion close by the support side, or that a satisfactory gradient cannot be obtained by interfering with the developability, etc., because of the fact that an emulsion layer having the different color photosensitivity is arranged between the green photosensitive emulsion layers.

To cope therewith, when a sensitization is made in order to increase the sensitivity of the above-mentioned lowly green photosensitive emulsion layer, the worsening of the graininess is observed, therefore it has been considered difficult that the gradient and graininess are satisfied at the same time by means of the conventional technology. Especially, the characteristics of the dye image formed in a green photosensitive emulsion layer control fundamentally the image quality of a final photographic product such as a color print, and accordingly the above-mentioned defects have become the essential problems to be overcome. Further in a multi-layered color photosensitive material having the above-mentioned arrangement, there are the defects also that the colored image density of the green photosensitive emulsion layer thereof worsens itself in the stability against the conditions of developing process such as pH value, temperature and time. Accordingly, an object of the present invention is to provide a silver halide color photosensitive material for taking a photograph of which the sensitivity of the green photosensitive emulsion layer is improved and the graininess and the gradient are also improved without any interference with the sensitivity of the green photosensitive emulsion layer and further the development stability is superior.

As the result that the present inventors devoted in the continuous studies in every way of the above-mentioned problems, the aforesaid object of the invention can be achieved with a silver halide color photosensitive material for taking a photograph comprising a red photosensitive silver halide emulsion layer, a green photosensitive silver halide emulsion layer and blue photosensitive silver halide emulsion layer and each of which comprises a coupler out of every three kinds of the couplers, namely, anti-diffusive yellow, magenta and cyan couplers, and in which said green photosensitive silver halide emulsion layer is composed of at least two layers and between those of which said red photosensitive silver halide emulsion layer is arranged, and said green photosensitive silver halide emulsion layer comprises an anti-diffusive yellow coupler.

In accordance with the invention, there is proposed a novel color photosensitive material specifically combining the improved layer arrangements and the couplers, and also tried to overcome the aforesaid problems.

The further detailed description will be made hereunder on the color photosensitive materials of the invention.

The color photosensitive material of the invention is characterized in that the layer arrangement thereof is made upon the support so as to be provided with a red photosensitive silver halide emulsion layer, a green photosensitive silver halide emulsion layer and a blue photosensitive silver halide emulsion layer, and the above-mentioned green photosensitive layer is composed of at least two layers and at the same time the above-mentioned red photosensitive silver halide emulsion layer is interposed between the above-mentioned green photosensitive lyers, and also the green photosensitive silver halide emulsion layer is contained with anti-diffusive yellow couplers.

In the present invention, as described above, the green photosensitive silver halide emulsion layer comprises two layers of which one layer is made highly sensitive to green color and the other is made lower in green photosensitivity. And in the present invention, the above-mentioned highly green sensitive layer and lowly green photosensitive layer may further comprise two layers respectively, however in this case, it is preferable that the layer closer by the support is of the lowest in the sensitivity. The sensitivity difference between the highly green photosensitive layer and the lowly green photosensitive layer which are to be used in the invention may be obtainable at the most suitable point in consideration of the gradient and graininess thereof through a method publicly known, and generally, it is preferable to be the difference at 0.1–1.0 log E (E: Amount of exposure to light).

In the invention, it is possible to add either arbitrary one of magenta coupler and cyan coupler selectably in the blue photosensitive emulsion layer and the red photosensitive layer, provided that the couplers in the identical hue are not in the both layers.

And, in occasion demands, an impure color prevention interlayer may be arranged between the constitutional layers of a color photosensitive material of the invention, and as for the said interlayers, the ones containing hydroquinone derivatives, fine grained silver halide or the like are used for controlling the developments being respectively progressed between the emulsion layers.

Next, in the invention, the anti-diffusive yellow couplers to be used in a green photosensitive silver halide emulsion layer may be suitably selected out from those which have so far been publicly known, and they are, for example, given in Research Disclosure, vol. 176, No. 17643 VII, p. 25 (Dec., 1978).

Among the above-mentioned publicly known yellow couplers, the preferable ones are of the high speed reactive, and more particularly it is desirable that more than 20 mol% of the aggregate amount of yellow couplers contained in an emulsion layer are the high speed reactive yellow couplers.

In other words, the said preferable yellow couplers mean the couplers of which the relative reaction speed is more than double, preferably more than three times as fast as the reaction speed of the coupler shown hereunder (Y-B) that is taken as the standard. The reaction speed in this case is determined by the method described in Report by Agfa Leverkusen/Munchen Laboratories (mitteilungen ausdem Forschungs Laboratorien der Agfa Leverkusen/Munchen) vol. III, p. 81, (Schplinger Press, Berlin-Gottingen-Heidelberg, 1961)

(Y-B)

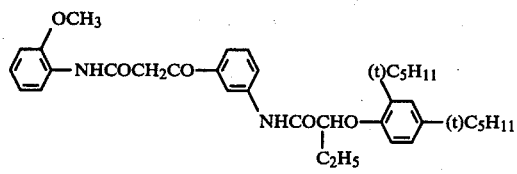

As for the high speed reactive couplers to be used in the present invention, anti-diffusive two equivalent yellow couplers are preferable, and, inter alia, those which are formulated in the following general formulae [I] to [V] are given:

General Formula [I]

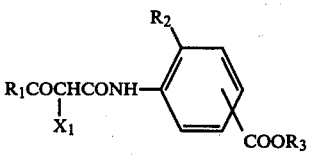

Wherein, $R_1$ represents a tertiary butyl group or an aryl group, $R_2$ represents a hydrogen atom, a halogen atom (e.g., a chlorine atom, a fluorine atom or bromine atom) or an alkoxy group (preferably a lower alkoxy group having 1–3 carbon atoms), $R_3$ represents an alkyl group, alkenyl group, aralkyl group, cycloalkyl group, aryl group or heterocyclic residual group, and $X_1$ represents a cyclic diacylamino group, a cyclic monoacylamino group or a triazole ring residual group in which a nitrogen atom couples directly to a carbon atom at the active site in the formula. The aforesaid each group of $R_1$, $R_2$ and $X_1$ may have a substituent. Further, in order to make the compounds formulated in General Formula [I] anti-diffusive, it is preferable that the aggregate number of the carbon atoms of $R_1$, $R_2$ and $R_3$ is more than eight, and it is particularly preferable that $R_3$ has more than eight carbon atoms.

General Formula [II]

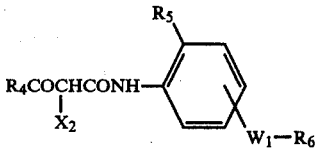

Wherein, $R_4$ and $R_5$ represent the groups represented by $R_1$ and $R_2$ in the aforegoing general formula [I], respectively, $W_1$ represents $—SO_2—$ group, $—SO_2NH—$ group or $—NHSO_2—$ group, $R_6$ represents alkyl group, aryl group or heterocyclic residual group, and $X_2$ represents a cyclic diacylamino group, a cyclic monoacylamino group, a triazole ring residual group in which a nitrogen atom couples directly to a carbon atom at the active site in the formula, an aryloxy group, an acyloxy group or an arylthio group. And, each group of the said $R_4$, $R_5$, $R_6$ and $X_2$ may have a substituent. Further, in order to make the compounds formulated in General Formula [II] anti-diffusible, it is preferable that the aggregate number of the carbon atoms of $R_4$, $R_5$ and $R_6$ is more than eight, and it is particularly preferable that $R_6$ has more than eight carbon atoms.

General Formula [III]

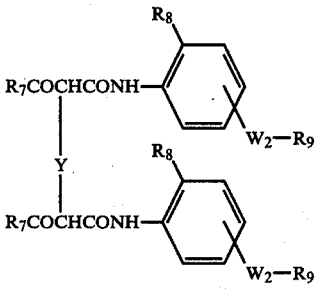

Wherein, $R_7$ and $R_8$ represent respectively the groups represented by $R_1$ and $R_2$ in the foregoing general formula [I], $W_2$ represents

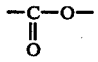

group (provided that a carbon atom couples directly to a benzene ring), $—NHSO_2—$ group or $—SO_2NH—$ group, $R_9$ represents alkyl group, aryl group or heterocyclic residual group, and Y represents a bivalent organic group formulated in the formulae,

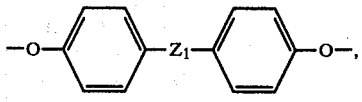

-continued

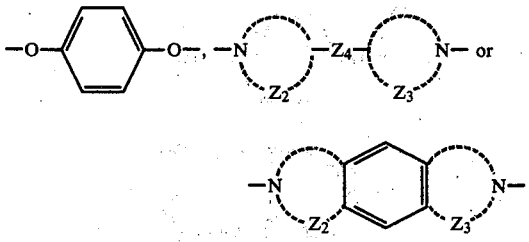

Wherein, $Z_1$ represents sulfonyl group, carbonyl group or alkylenedisulfonamide group; $Z_2$ and $Z_3$ represent the atomic groups of nonmetals necessary for forming 4–6 membered hetero ring together with a nitrogen atom; and $Z_4$ represents a simple coupling hand or a bivalent organic group (e.g., alkylene group, alkenylene group, arylene group, oxyalkyleneoxy group, oxyaryleneoxy group, sulfonylalkylenesulfonyl group, sulfonylarylenesulfonyl group or alkylene arylenealkylene group). And, the aforesaid the each group of $R_7$, $R_8$, $R_9$ and Y may have a substituent. Further, in order to make the compounds formulated in General Formula [III] anti-diffusible, it is preferable that the aggregate number of the carbon atoms of $R_7$, $R_8$ and $R_9$ is more than eight, and it is particularly preferable that $R_9$ has more than eight carbon numbers.

General Formula [IV]

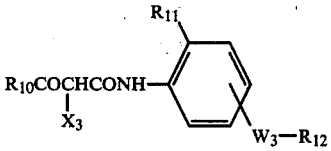

Wherein, $R_{10}$ and $R_{11}$ represent the groups represented respectively by $R_1$ and $R_2$ in the aforesaid general formula [I]; $W_3$ represents —NHCO— group or —CONH— group; and $R_{12}$ represents aryl group or heterocyclic residual group. $X_3$ represents a cyclic diamino group, a cyclic monoacylamino group, a thiazole ring residual group in which a nitrogen atom couples directly to a carbon atom at the active site in the formula, an aryloxy group, an acyloxy group or an arylthio group. And, each group of the said $R_{10}$, $R_{11}$, $R_{12}$ and $X_3$ may have a substituent. Further, in order to make the compounds formulated in General Formula [IV] anti-diffusible, it is preferable that the aggregate number of the carbon atoms of $R_{10}$, $R_{11}$ and $R_{12}$ is more than eight, and it is particularly preferable that $R_{12}$ has more than eight carbon atoms.

General Formula [V]

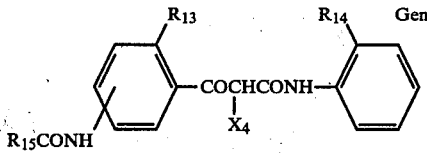

Wherein, $R_{13}$ and $R_{14}$ represent the groups represented respectively by $R_1$ and $R_2$ in the aforesaid general formula [I]; $R_{15}$ represents alkyl group, aryl group or heterocyclic residual group, and $X_4$ represents a cyclic diacylamino group, a cyclic monoacylamino group, a triazole ring residual group in which a nitrogen atom couples directly to a carbon atom at the active site in the formula, an aryloxy group, an acyloxy group or an arylthio group. And each group of the said $R_{13}$, $R_{14}$, $R_{15}$ and $X_4$ may have a substituent. Further, in order to make the compounds formulated in General Formula [V] anti-diffusible, it is preferable that the aggregate number of the carbon atoms of $R_{13}$, $R_{14}$ and $R_{15}$ is more than eight, and it is particularly preferable that $R_{15}$ has more than eight carbon atoms. Each group of $X_1$ to $X_4$ and Y in the aforegoing general formulae [I] to [V] is eliminable in the process of development, those of which the examples are given herein:

1 $-COCH_3$

2

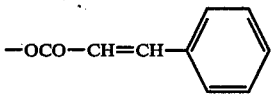

3

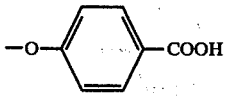

4

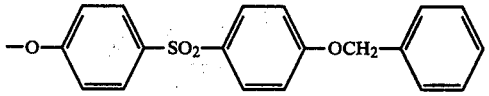

5

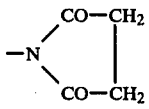

6

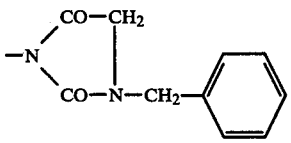

7 $-OCOC_{10}H_{21}$

8

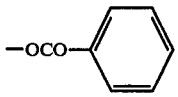

-continued
9
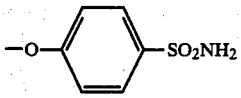
10
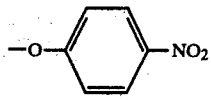
11
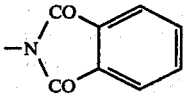
12
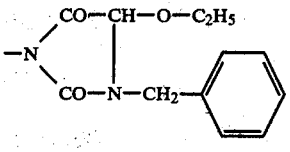
13
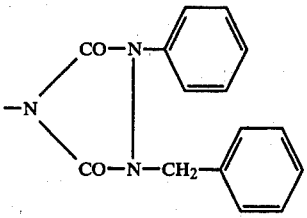
14
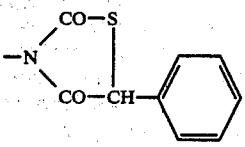
15
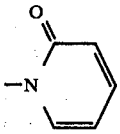
16
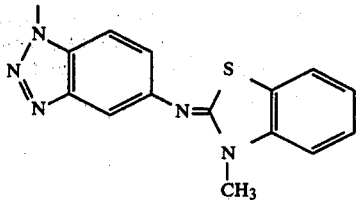
17
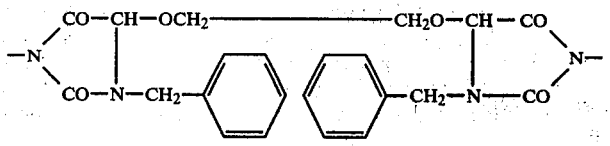
18
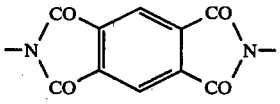
19
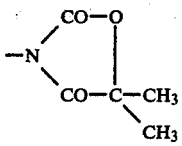
20
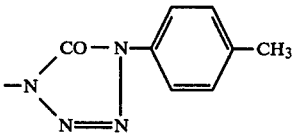
21
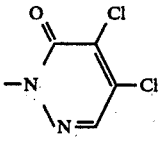
22
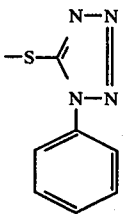
23
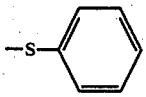
24
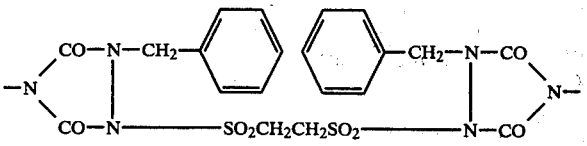

-continued
25
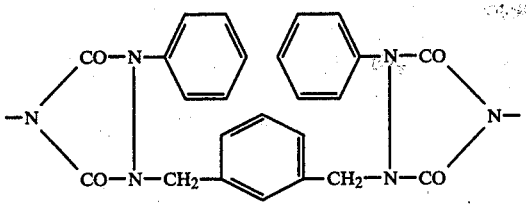
26
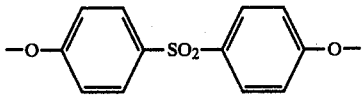
27
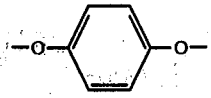
28
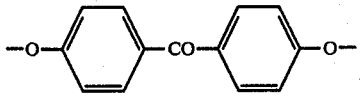
29
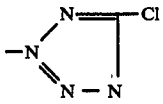
30
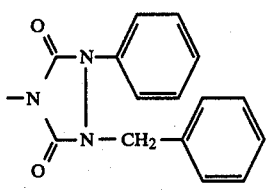
Among the couplers formulated in the aforegoing general formulae [I] to [V], the particularly effective couplers are those formulated in General Formulae [I] to [III].
The following are given as the examples of the high speed reactive couplers of the present invention, however it is to be understood that the invention is not limited thereto.
Y-1
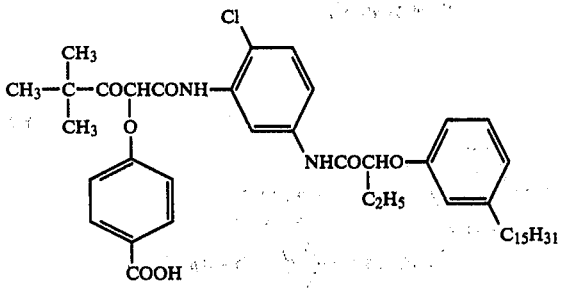
Y-2
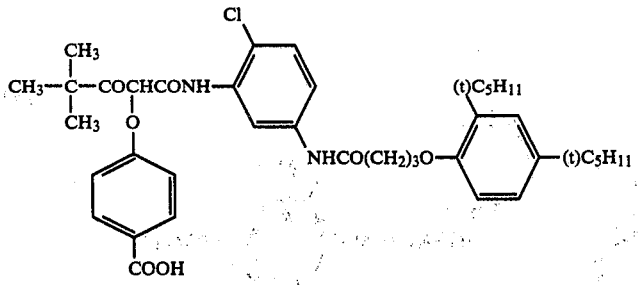

-continued
Y-3
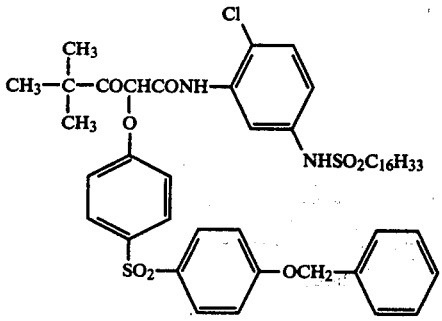
Y-4
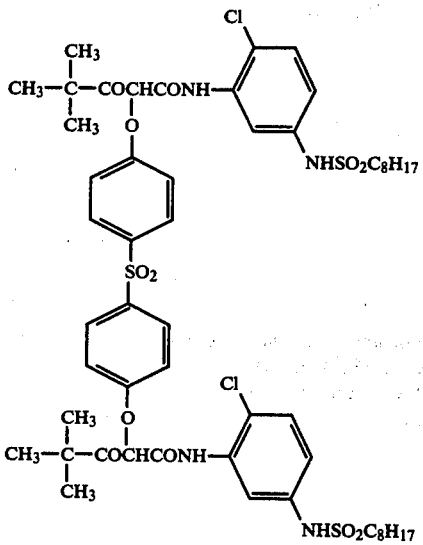
Y-5
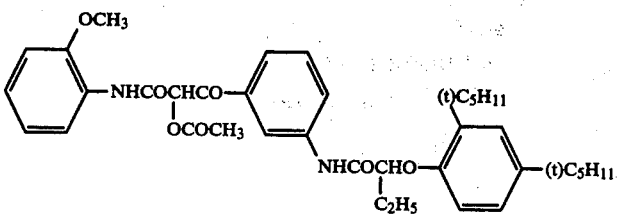
Y-6
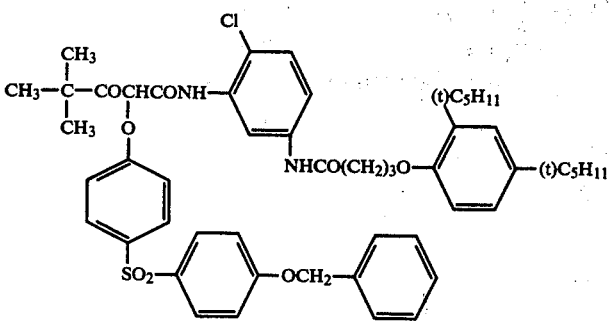

-continued
Y-7
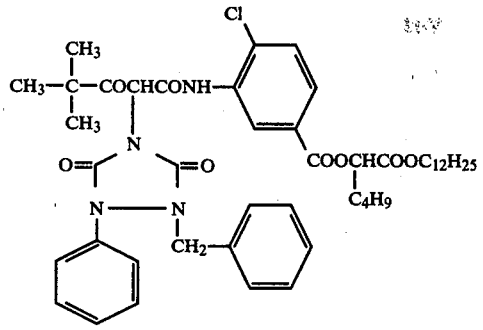
Y-8
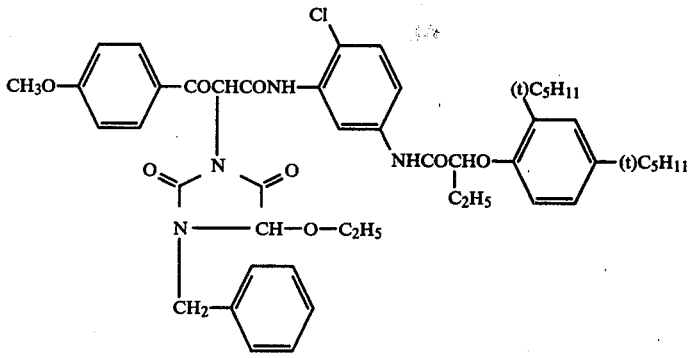
Y-9
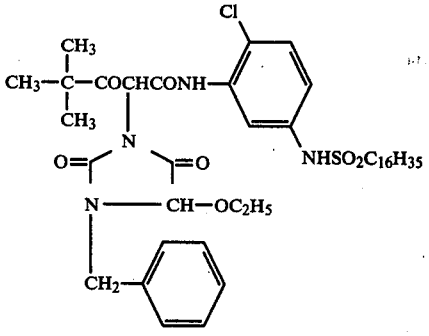
Y-10
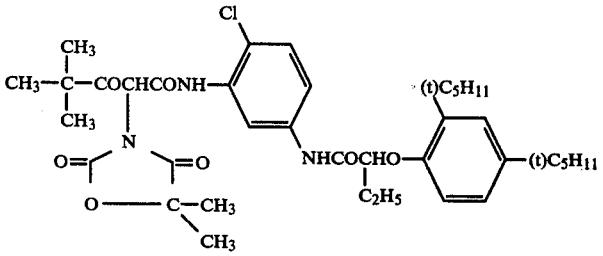
Y-11
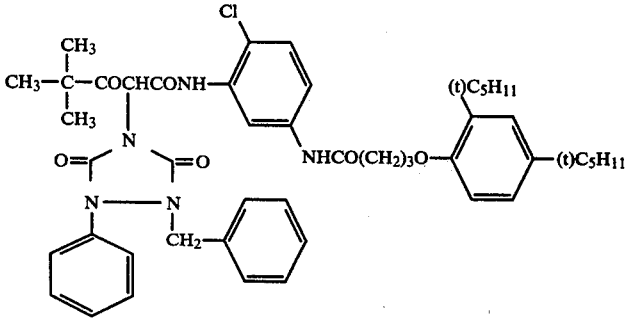

-continued
Y-12
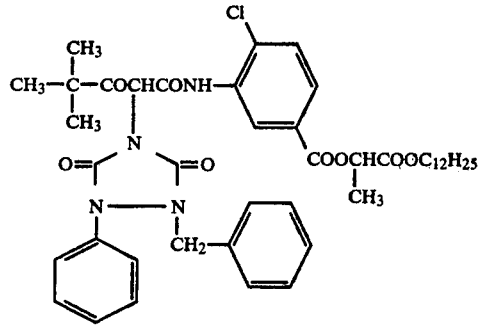
Y-13
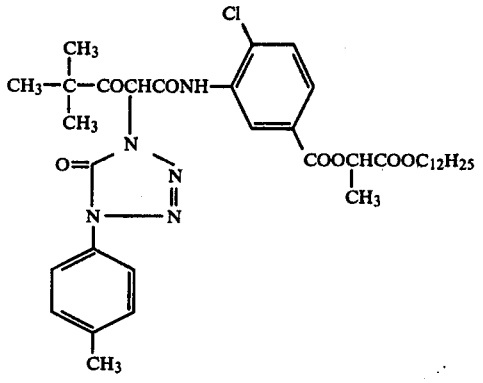
Y-14
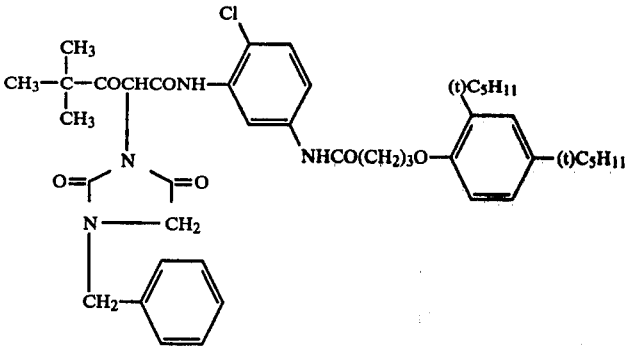
Y-15
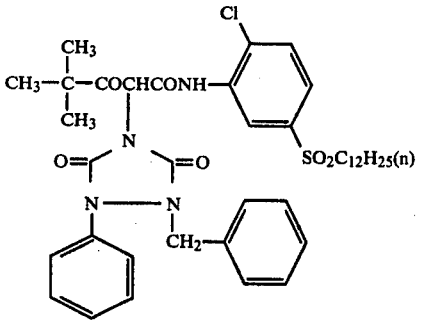
Y-16
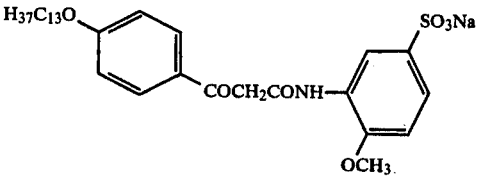

-continued
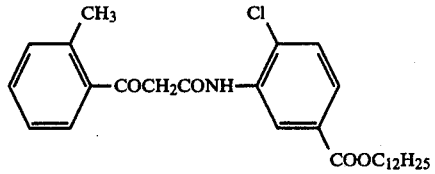
Y-17
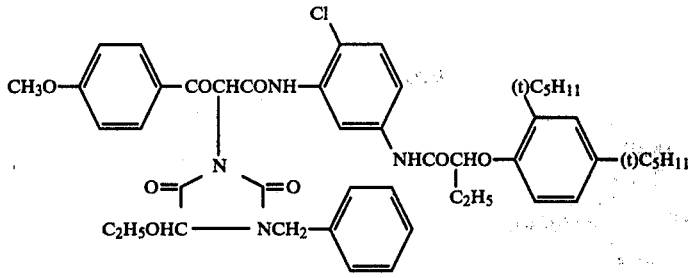
Y-18
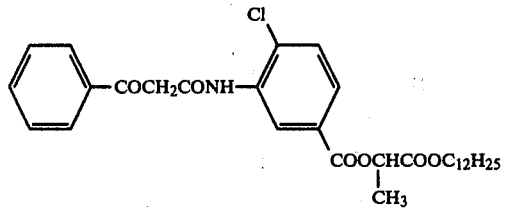
Y-19
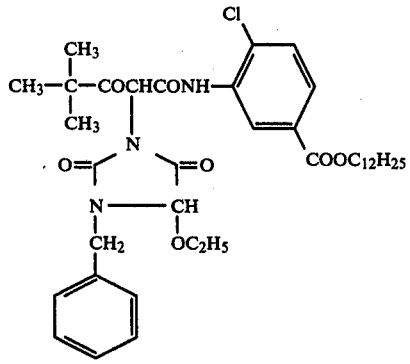
Y-20
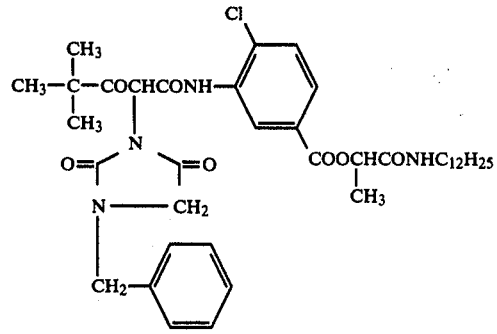
Y-21

-continued
Y-22
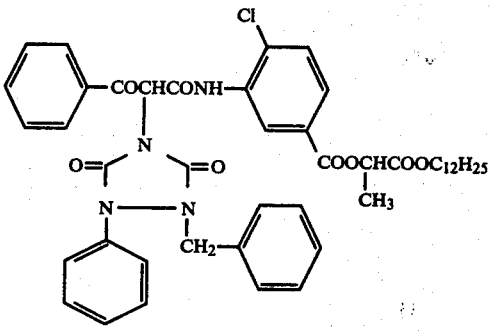
Y-23
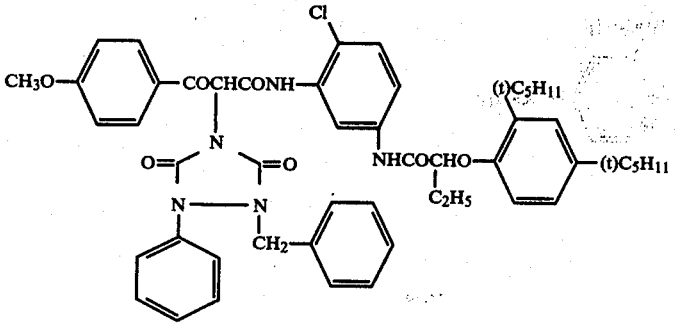
Y-24
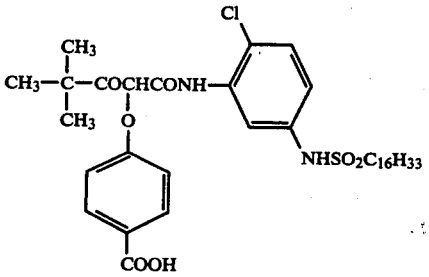
Y-25
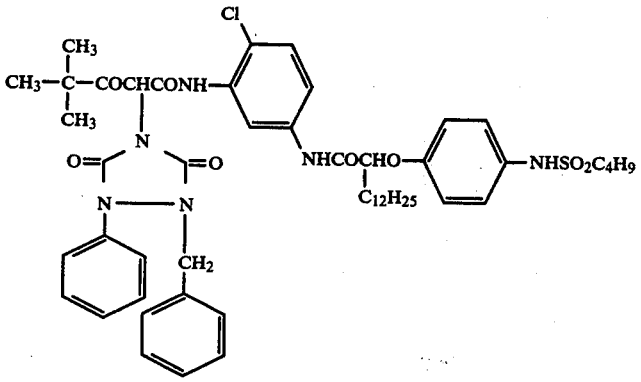
Y-26
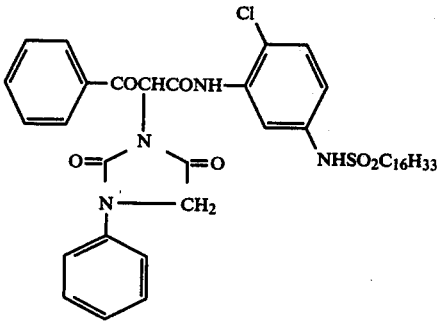

-continued
Y-27
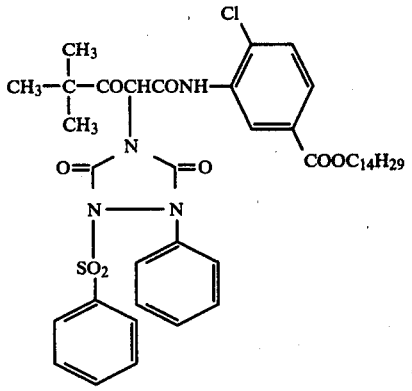
Y-28
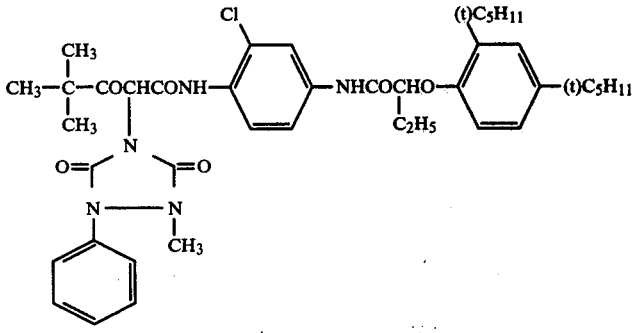
Y-29
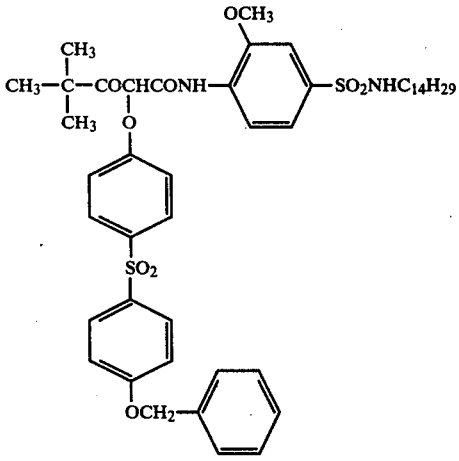
Y-30
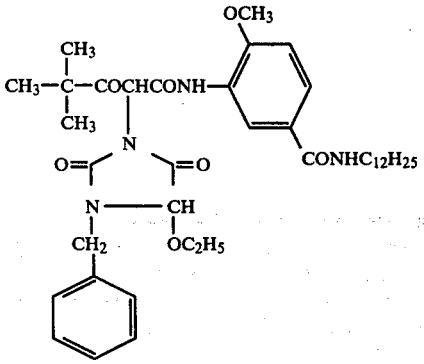

-continued

Y-31

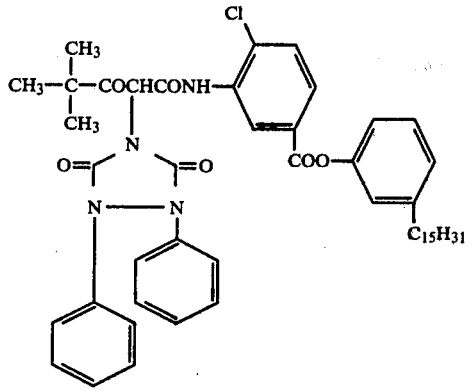

Y-32

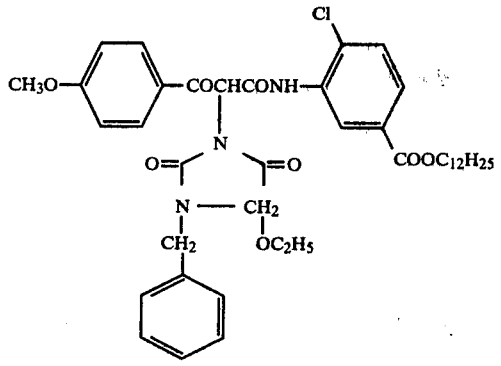

Y-33

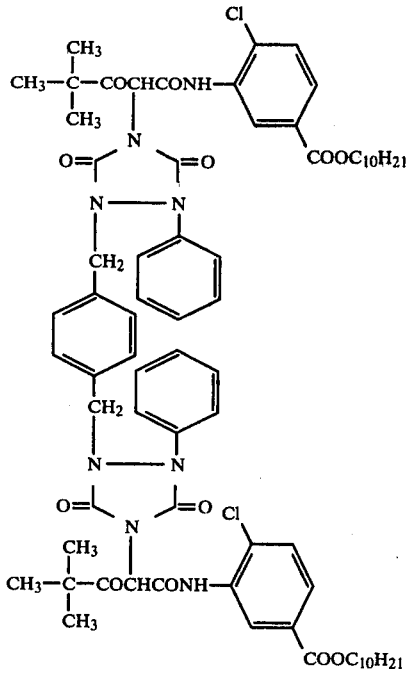

In the invention, the color density of a highly green photosensitive emulsion layer after developed is less than one half, preferably one third, of the color density of all the green photosensitive emulsion layers.

In order to improve the efficiency of the invention, it is preferable to contain into a lowly green photosensitive emulsion layer or the neighboring layer thereto with a compound reacting to an oxide of developing agent and releasing a developing inhibitor (hereinafter referred to as "DIR compound"). With respect to DIR compounds, the detailed description thereof has been made in U.S. Pat. No. 3,227,554, for example. DIR compounds are used in the amount up to the rate of 2 mg/dm$^2$, by volume, preferably 0.1–0.9 mg/dm$^2$, by volume, to the area of the above-mentioned arranged layer.

Next, as for the anti-diffusive magenta couplers to be used in the color photosensitive materials relating to the invention, pyrazolone compounds, indazolone compounds, cyanoacetyl compounds or the like can be used, and as for the anti-diffusive cyan couplers thereto, phenol compounds, naphthol compounds or the like can be used.

As for the anti-diffusive magenta couplers, there can be selected out from the couplers described in, for example, U.S. Pat. Nos. 2,600,788, 3,558,319, 3,468,666, 3,419,391, 3,311,476, and 3,253,924, British Pat. No. 1,293,640, Japanese Patent Application No. 21,454/1973, U.S. Pat. Nos. 2,434,272, 3,476,564 and 3,476,560, and Japanese Patent Application No. 45,971/1973. And, as for the anti-diffusive cyan couplers which can be used in the invention, there can be selected out from the couplers described in U.S. Pat. Nos. 2,369,929, 2,474,293, 3,591,383, 2,895,826, 3,458,315, 3,311,476, 3,419,390, 3,476,563 and 3,253,924, British Pat. No. 1,201,110, and U.S. Pat. Nos. 3,034,892, 3,386,301 and 2,434,272.

Further, as for the colorless couplers which can jointly be used in the invention, there can be selected out from the couplers described in British Pat. Nos. 861,138, 914,145 and 1,109,963, Japanese Patent Examined Publication No. 14033/1970, U.S. Pat. No. 3,580,722, and Mitteilungen ausdem Forschnings Laboratorien der Agfa Leverkusen, vol. IV, pp. 352-367, 1964.

In the present invention, the amount used of the said anti-diffusive couplers is normally at the rate of $2\times10^{-3}$ mol to $5\times10^{-1}$ mol, preferably, $1\times10^{-2}$ mol to $5\times10^{-1}$ mol against one mol of silver in a photosensitive silver halide emulsion layer.

As for the processes for dispersing anti-diffusive couplers, there can suitably be selected out from a variety of processes such as the so-called alkaline solution dispersion process, solid dispersion process, latex dispersion process, and oil drop-in-water type emulsifying dispersion process, in accordance with the chemical structure of the anti-diffusive couplers thereof.

In the present invention, the latex dispersion process or the oil drop-in-water type emulsifying dispersion process is particularly effective. These processes have so far been well known. The latex dispersion process and the effects thereof have been described in Japanese Patent Open to Public Inspection Nos. 74538/1974, 59943/1976 and 32552/1979 and Research Disclosure, No. 14850, pp. 77-79, August, 1976.

The suitable latexes for the purpose are the homopolymers, copolymers and terpolymers such as styrene, ethyl acrylate, n-butyl acrylate, n-butyl methacrylate, 2-acetoacetoxyethyl methacrylate, 2-(methacryloyloxy)ethyltrimethylammonium methosulfate, 3-(methacryloyloxy)propane-1-sodium sulfonate, N-isopropyl acrylamide, N-[2-(2-methyl-4-oxopentyl)]acrylamide, or 2-acrylamide-2-methyl propane sulfonic acid, as for the oil drop-in-water type emulsifying dispersion processes, there can be used the so far well known processes in which hydrophobic additives such as couplers are dispersed. The couplers to be used in the present invention may be dispersed independently, or said couplers and the couplers to be jointly used may either be dispersed at the same time or be dispersed separately and then be added.

In the color photosensitive materials of the present invention, it is preferable to embody a blue photosensitive silver halide emulsion layer out of the three different photosensitive silver halide emulsion layers so as to arrange at the farthest position from the support of the photosensitive material, and also it is preferable that such blue photosensitive silver halide emulsion layer is combined with anti-diffusive magenta couplers.

Silver halide which is to be used for the silver halide emulsion layers of color photosensitive materials relating to the invention includes any arbitrary ones being used in a normal type of silver halide photographic emulsions such as silver chloride, silver bromide, silver iodide, silver chlorobromide, silver iodobromide, and silver chloroiodobromide.

The grains of said silver halide may be either of the coarse or of the fine, and the grain diameter may as well distribute large or small. And, the crystals of said silver halide grains may be of the normal or of the twin, and the arbitrary ratio of surface [100] to surface [111] can be used. Further, the structure of these silver halide grain crystal may be of the homogeneous substance all through or may also be of the heterogeneous layers of which the inside and the outside are different from each other. Still further, these silver halide may be of the type that a latent image is mainly formed on the surface thereof or may also be of the type that a latent image is formed inside the grains thereof. These silver halide can be prepared through a publicly known process being commonly used by the skilled in the art.

It is preferable to remove soluble salts from the silver halide emulsions to be used in the invention, however, it is possible to use even if not removed. And, it is also possible that two or more silver halide emulsion each of which has been prepared separately are mixed together and then used.

As for the binders for the silver halide emulsions of the color photosensitive materials of the invention, there are given the ones that have so far been known, for example, gelatin derivatives and the like, such as gelatin, phenyl carbamylated gelatin, acylated gelatin, and phthalated gelatin. These binders can be used to serve as two or more compatible mixtures in occasion demands.

Silver halide photographic emulsion in which said silver halide grains were dispersed in binder, can be sensitized by a chemical sensitizer. The effective chemical sensitizers which can jointly be used in the invention are classified roughly into the following four kinds, viz., noble metal sensitizers, sulphuric sensitizers, selenium sensitizers and reduction sensitizers.

As for the noble metal sensitizers, gold compounds and the compounds of ruthenium, rhodium, palladium, iridium or platinum, can be used.

And, when gold compound is used, ammonium thiocyanate or sodium thiocyanate can further jointly be used.

As for the sulphuric sensitizers, active gelatin and sulphuric compounds can be used.

As for the selenium sensitizers, both active and inactive selenium compounds can be used.

As for the reduction sensitizers, there are given monovalent tin salt, polyamine, bisalkylaminosulfide, silane compounds, imino aminomethane sulfinic acid, hydrazinium salts and hydrazine derivatives.

In the color photosensitive materials of the invention, besides the aforesaid additives a variety of the useful additives are used, such as stabilizer, development accelerator, emulsion hardener, surface active agent, contamination inhibitor, lubricant, ultraviolet rays absorbent and the like.

In the silver halide photosensitive materials of the invention, besides the silver halide emulsion layer, the auxiliary layers such as a protective layer, interlayer, filter layer, anti-halation layer and back layer, can suitably be provided.

As for the supports, there can be suitably selected from the supports which have so far been known such as a plastic film, plastic laminated paper, baryta paper, or synthetic paper, in accordance with the purposes of the use. These supports are usually provided with the subcoating in order to strengthen the adhesion thereof to the photographic emulsion layers.

Next, the following illustrates the preferable embodiments of the principal layer arrangement in the color photosensitive materials of the invention. The order of the layer arrangements herein is designated from the surface layer side to the support side.

(Illustration 1)

1. One or more blue photosensitive silver halide emulsion layers containing anti-diffusive magenta couplers.
2. Yellow filter layer absorbing a blue light.
3. Highly green photosensitive silver halide emulsion layer containing anti-diffusive yellow couplers.
4. One or more red photosensitive silver halide emulsion layers containing anti-diffusive cyan couplers.
5. Lowly green photosensitive silver halide emulsion layer containing anti-diffusive yellow couplers.
6. Support.

(Illustration 2)

1. One or more blue photosensitive silver halide emulsion layers containing anti-diffusive magenta couplers.
2. Yellow filter layer absorbing a blue light.
3. Highly green photosensitive silver halide emulsion layer containing anti-diffusive yellow couplers.
4. Highly red photosensitive silver halide emulsion layer containing anti-diffusive cyan couplers.
5. Lowly green photosensitive silver halide emulsion layer containing anti-diffusive yellow couplers.
6. Lowly red photosensitive silver halide emulsion layer containing anti-diffusive cyan couplers.
7. Support.

(Illustration 3)

1. One or more blue photosensitive silver halide emulsion layer containing anti-diffusive cyan couplers.
2. Yellow filter layer absorbing a blue light.
3. Highly green photosensitive silver halide emulsion layer containing anti-diffusive yellow couplers.
4. Highly red photosensitive silver halide emulsion layer containing anti-diffusive magenta couplers.
5. Lowly green photosensitive silver halide emulsion layer containing anti-diffusive yellow couplers.
6. Lowly red photosensitive silver halide emulsion layer containing anti-diffusive magenta couplers.
7. Support.

It is possible to obtain images from the illustrated color photosensitive materials of the invention after exposed to light, through the color developing process of common use. The fundamental processing steps of the negative-positive method include the steps of color developing, bleaching and fixing. There are instances where each of said fundamental processing steps is taken independently, and there are also other instances where a single processing step is taken in place of two or more said fundamental processing steps by making use of a processing solution having such function. For example, they are given the monobath color process containing developing agent, ferric salt bleaching component and thiosulfate fixing component, or the monobath bleach-fix process containing ethylenediamine tetraacetic acid iron (III) complex salt bleaching component and thiosulfate fixing component.

There is no particular limitation to the processes for the color photosensitive materials of the invention and anyone of the processes can be applied thereto. As for the typical examples, there are given the processes such as the one in which, after the color development was finished, a bleach-fix processing step is taken and a wash-stabilizing step is further taken if needed; the one in which, after the color development was finished, a bleaching step and a fixing step are taken separately and a wash-stabilizing step is further taken if needed; the one in which the steps are taken in the order of prehardening, neutralizing, color developing, stop-fixing, washing, bleaching, fixing, washing, afterhardening and washing; the one in which the steps are taken in the order of color developing, washing, supplementary color developing, stopping, bleaching, fixing, washing and stabilizing; the developing process in which developed silver produced by color development is halogenatingly bleached and then the amount produced of dyes are increased by the color development for the second time; or the one in which a silver saving photosensitive material is processed by making use of an amplifier such as peroxide or cobalt complex salt; every one of which may be used to process.

As for the color developing agents, p-phenylenediamine is of the typical.

And, the color developing agents can be used by making addition thereof to a color photosensitive material. As for the precursors of the developing agents to be used in the invention, there can be applied the precursors such as Schiff's base type precursors of color developers described in U.S. Pat. Nos. 2,507,114, 2,695,234 and 3,342,599, and Research Disclosure, vol. 151, No. 15159, Nov. 1979; and the precursors described in Research Disclosure, vol. 129, No. 12924, Oct. 1976, ibid., vol. 121, No. 12146, Jun. 1974, ibid., vol. 139, No. 13924, Nov. 1975.

And, it is possible to add a variety of additives in a color developer in occasion demands.

It is possible to form a color image on a photosensitive material for printing use by making use of a color photosensitive material of the invention, and the combination of the color photosensitive material and the photosensitive material for printing use, and the respective combination of the photosensitive silver halide emulsion layer and the antidiffusive couplers thereof are given as follows:

(1) Combination of color photosensitive material A and photosensitive material for printing use A:

Color photosensitive material A:

Color photosensitive material in which, on the support thereof, antidiffusive cyan couplers are combined with the red photosensitive silver halide emulsion layer thereof, anti-diffusive yellow couplers are combined with the green photosensitive silver halide emulsion layer thereof, and anti-diffusive magenta couplers are combined with the blue photosensitive silver halide emulsion layer thereof. Photosensitive material for printing use A:

Photosensitive material for printing use in which, on the support thereof, anti-diffusive cyan couplers are combined with the red photosensitive silver halide emulsion layer thereof; anti-diffusive yellow couplers are combined with the green photosensitive silver halide emulsion layer thereof, and anti-diffusive magenta couplers are combined with the blue photosensitive silver halide emulsion layer thereof.

(2) Combination of color photosensitive material B and photosensitive material for printing use B:

Color photosensitive material B:

Color photosensitive material in which, on the support thereof, anti-diffusive magenta couplers are combined with the red photosensitive silver halide emulsion layer thereof; anti-diffusive yellow couplers are combined with the green photosensitive silver halide emulsion layer thereof; and anti-diffusive cyan couplers are combined with the blue photosensitive silver halide emulsion layer thereof.

Photosensitive material for printing use B:

Photosensitive material for printing use in which, on the support thereof, anti-diffusive yellow couplers are combined with the red photosensitive silver halide emulsion layer thereof; anti-diffusive cyan couplers are combined with the green photosensitive silver halide emulsion layer thereof; and anti-diffusive magenta couplers are combined with the blue photosensitive silver halide emulsion layer thereof.

As for the materials to be used for said photosensitive materials for printing use, the additives thereof and the like, it is used that which have so far been known in the conventional types of photosensitive materials for printing use.

The invention will be more clearly understood with reference to the following Examples, and it is, however, to be understood that the invention is not limited thereto.

EXAMPLE 1

Based on the technology disclosed by Japanese Patent Open to Public Inspection No. 49027/1976, Example 1 was prepared by coating with the following each layer onto the support comprising a subcoated cellulose triacetate film.

Layer-1 . . . Anti-halation layer

Black colloidal silver was dispersed in a gelatin solution and thus obtained solution was coated on said support at the ratio of 3 g/m$^2$ of gelatin to 0.4 g/m$^2$ of silver so that the dry thickness thereof can become 2.0$\mu$.

Layer-2 . . . Lowly red photosensitive silver halide emulsion layer

Silver iodobromide emulsion containing 4 mol% of silver iodide was prepared through a normal process (Average grain size: 0.5$\mu$, and 0.25 mol of silver halide and 40 g of gelatin, per 1 kg of the emulsion, contained). The emulsion of 1 kg thus obtained was chemically sensitized by gold and sulphuric sensitizers, and was further added with p-ethyl-3,3'-di-(3-sulfopropyl)-4,5,4',5'-dibenzothiacarbocyanine hydroxide anhydrous and 5,5'-dichloro-9-ethyl-3,3'-di-(3-sulfopropyl)thiacarbocyanine hydroxide anhydrous to serve as the red photosensitizing dyes, and was then added with 0.25 g of 4-hydroxy-6-methyl-1,3,3a,7 tetrazaindene, 20 mg of 1-phenyl-5-mercaptotetrazole and 0.2 g of polyvinyl pyrolidone, and was still further added with 500 ml of the below-mentioned dispersed matter (C-1). The lowly red photosensitive silver halide emulsion layer thus obtained was coated so that the dry thickness thereof can be 3.0$\mu$.

Layer-3 . . . Interlayer

Gelatin solution was coated so that the dry thickness thereof can be 1.0$\mu$.

Layer-4 . . . Lowly green photosensitive silver halide emulsion layer

Silver iodobromide emulsion containing 6 mol% of silver iodide was prepared through a normal process (Average grain size: 0.3$\mu$. 0.25 mol of silver halide and 40 g of gelatin, per 1 kg of the emulsion, contained), and thus obtained emulsion of 1 kg was chemically sensitized by gold and sulphuric sensitizers, and was further added with 5,5'-dichloro-9-ethyl-3,3'-di-(3-sulfopropyl-)oxacarbocyanine hydroxide anhydrous, 5,5'-diphenyl-9-ethyl-3,3'-di-(3-sulfopropyl)oxacarbocyanine anhydrous and 9-ethyl-3,3'-di-(3-sulfopropyl)-5,6,5',6'-dibenzoxacarbocyanine hydroxide anhydrous to serve as the green photosensitizing dyes, and was then added with 0.25 g of 4-hydroxy-6-methyl-1,3,3a,7 tetrazaindene, 20 mg of 1-phenyl-5-mercaptotetrazole and 0.2 g of polyvinyl pyrolidone, and thus the sensitized emulsion A was obtained. And, silver iodobromide emulsion containing 6 mol% of silver iodide was prepared separately from Emulsion A through a normal process (Average grain size: 0.6$\mu$. 0.25 mol of silver halide and 40 g of gelatin, per 1 kg of the emulsion, contained) and sensitized in the same process as in the case of the aforesaid emulsion A but by making use of sensitizers and stabilizers half as much as in Emulsion A, and then Emulsion A and B were mixed together at the ratio of 1 to 1. Next, the below-mentioned dispersed matter (M-1) of 500 ml was added in 1 kg of the mixed emulsion and a lowly green photosensitive silver halide emulsion was prepared and then coated so that the dry thickness thereof can be 3.0$\mu$.

Layer-5 . . . Interlayer

Gelatin solution was coated so that the dry thickness thereof can be 0.7$\mu$.

Layer-6 . . . Highly red photosensitive silver halide emulsion layer

Silver iodobromide emulsion containing 7 mol% of silver iodide was prepared through a normal process (Average grain size: 1.2$\mu$. Silver halide of 0.25 mol and 30 g of gelatin, per 1 kg of the emulsion, contained). Thus prepared emulsion of 1 kg was chemically sensitized by gold and sulphuric sensitizers, and was further added with 9-ethyl-3,3'-di-(3-sulfopropyl)-4,5,4',5'-dibenzothiacarbocyanine hydroxide anhydrous and 5,5'-dichloro-9-ethyl-3,3'-di-(3-sulfopropyl)thiacarbocyanine hydroxide anhydrous to serve as the red photosensitizing dyes, and was then added with 0.25 g of 4-hydroxy-6-methyl-1,3,3a,7 tetrazaindene, 8 mg of 1-phenyl-5-mercaptotetrazole and 0.2 g of polyvinyl pyrolidone and was still further added with 500 ml of the below-mentioned dispersed matter (C-2). Thus obtained highly red photosensitive silver halide emulsion was coated so that the dry thickness thereof can be 2.0$\mu$.

Layer-7 . . . Interlayer

Gelatin solution was coated so that the dry thickness thereof can be 0.7$\mu$.

Layer-8 . . . Highly green photosensitive silver halide emulsion layer.

Silver iodobromide emulsion containing 7 mol% of silver iodide was prepared through a normal process (Average grain size: 1.2$\mu$. silver halide of 0.25 mol and 30 g of gelatin, per 1 kg of the emulsion, contained). Thus prepared emulsion of 1 kg was chemically sensitized by gold and sulphuric sensitizers and was further added with 5,5'-dichloro-9-ethyl-3,3'-di-(3-sulfopropyl-)oxacarbocyanine hydroxide anhydrous, 5,5'-diphenyl-9-ethyl-3,3'-di-(3-sulfopropyl)oxacarbocyanine anhydrous and 9-ethyl-3,3'-di-(3-sulfopropyl)-5,6,5'6'-dibenzoxacarbocyanine hydroxide anhydrous to serve as the green photosensitizing dyes, and was still further added with 0.25 g of 4-hydroxy-6-methyl-1,3,3a,7 tetrazaindene, 5 mg of 1-phenyl-5-mercaptotetrazole and 0.2 g of polyvinyl pyrolidone. Next, 200 ml of the below-mentioned dispersed matter (M-1) was added thereto, and thus the highly green photosensitive silver halide emulsion was prepared and then coated so that the dry thickness thereof can be 2.0μ.

Layer-9 . . . Interlayer

Gelatin layer was coated so that the dry thickness thereof can be 1.0μ.

Layer-10 . . . Yellow filter layer

Dissolution of 3 g of 2,5-di-t-octyl hydroquinone and 1.5 g of di-2-ethylhexyl phthalate was made in 10 ml of ethyl acetate, and the solution thus dissolved was dispersed in 50 ml of 10% gelatin solution containing 0.3 g of sodium triisopropylnaphthalene sulfonate, and thus obtained dispersed solution was added in gelatin solution in which yellow colloidal silver was dispersed, and thus obrained matter was coated at the ratio of 0.9 g/m$^2$ of gelatin, 0.07 g/m$^2$ of 2,5-di-t-octyl hydroquinone and 0.12 g/m$^2$ of so that the thickness thereof can be 1.2μ.

Layer-11 . . . Lowly blue photosensitive silver halide emulsion layer

Silver iodobromide emulsion containing 8 mol% of silver iodide was prepared through a normal process (Average grain size: 0.3μ. Silver halide of 0.25 mol and 60 g of gelatin, per 1 kg of the emulsion, contained). Thus prepared emulsion of 1 kg was chemically sensitized by gold and sulphuric sensitizers, and was further added with 3,3'-di-(3-sulfopropyl)-5,5'-dimethoxycyanine to serve as the blue photosensitizing dye, and was then added with 0.25 g of 4-hydroxy-6-methyl-1,3,3a,7 tetrazaindene, 20 mg of 1-phenyl-5-mercaptotetrazole and 0.2 g of polyvinyl pyrolidone. Next, 500 ml of the below-mentioned dispersed matter (Y-1) and 4 g of 1,2-bis vinylsulfonyl ethane were added, and thus the lowly blue photosensitive silver halide emulsion was prepared and then coated so that the dry thickness thereof can be 2.5μ.

Layer-12 . . . Highly blue photosensitive silver halide emulsion layer

Silver iodobromide emulsion containing 7 mol% of silver iodide was prepared through a normal process (Average grain size: 1.3μ. Silver hlaide of 0.25 mol and 60 g of gelatin, per 1 kg of the emulsion, contained). Thus prepared emulsion of 1 kg was chemically sensitized by gold and sulphuric sensitizers, and was further added with 3,3'-di-(3-sulfopropyl)-5,5'-dimethoxycyanine to serve as the blue photosensitizing dye, and was then added with 0.25 g of 4-hydroxy-6-methyl-1,3,3a,7 tetrazaindene, 5 mg of 1-phenyl-5-mercaptotetrazole and 0.2 g of polyvinyl pyrolidone. Next, 200 ml of the below-mentioned dispersed matter (Y-1) and 4 g of 1,2-bisvinyl sulfonyl ethane were added, and thus the highly blue photosensitive silver halide emulsion was prepared and then coated so that the dry thickness thereof can be 2.5μ.

Layer-13 . . . Protective layer (1)

Coating solution containing gelatin and 1,2-bisvinylsulfonyl ethane at the ratio of 4.0 g and 0.2 g respectively to 100 ml of the solution was coated at the ratio of 1.3 g of gelatin/m$^2$ so that the dry thickness can be 1.2μ.

Layer-14 . . . Protective layer (2)

Gelatin solution containing 4.0 g of gelatin, 0.2 g of 1,2-bisvinylsulfonyl ethane and 0,1 g of silica gel having the average agrain diameter of 3.0μ respectively per 100 ml of the solution, was coated at the ratio of 0.9 g of gelatin/m$^2$ so that the dry thickness thereof can be 0.8μ.

The dispersed matters used in each of the above-mentioned emulsion layers were prepared as described below:

Dispersed matter (C-1)

The undermentioned cyan coupler (C-1) of 50 g, 4 g of colored cyan coupler (CC-1) and 0.5 g of DIR compound (D-1) were heatedly dissolved in the mixture of 55 g of tricresyl phosphate (hereinafter referred to as TCP) and 110 ml of ethyl acetate (hereinafter referred to as EA), and the solution thus obtained was added in 400 ml of 7.5% gelatin solution containing 4 g of sodium triisopropyl naphthalene sulfonate, and the emulsification and dispersion were made by means of a colloid mill to prepare 1000 ml.

Dispersed matter (C-2)

The undermentioned cyan coupler (C-2) of 10 g and 0.3 g of DIR compound (D-1) were heatedly dissolved in the mixture of 20 g of TCP and 50 ml of EA, and the solution thus obtained was added in 400 ml of 7.5% gelatin solution containing 2 g of sodium triisopropyl naphthalene sulfonate, and the emulsification and dispersion were made by means of a colloid mill to prepare 1000 ml.

Dispersed matter (M-1)

The undermentioned magenta coupler (M-1) of 45 g, 18 g of (M-2), 14 g of colored magenta coupler (CM-1) and 0.5 of DIR compound (D-2) were dissolved in the mixture of 77 g of TCP and 280 ml of EA, and thus obtained solution was added in 500 ml of 7.5% gelatin solution containing 8 g of sodium triisopropyl naphthalene sulfonate, and the emulsification and dispersion were made by means of a colloid mill to prepare 1000 ml.

Dispersed matter (Y-1)

The undermentioned yellow coupler (Y-B) of 300 g was heatedly dissolved in the mixture of 150 g of TCP and 500 ml of EA, thus obtained solution was added in 1600 ml of 7.5% gelatin solution containing 18 g of sodium triisopropyl naphthalene sulfonate, and the emulsification and dispersion were made by means of a colloid mill to prepare 2500 ml.

The couplers which were contained in the above-mentioned dispersed matters are give as follows:

C-1: 1-hydroxy-2-[δ-(2,4-di-tert-amylphenoxy)butyl]-naphthoamide

CC-1: 1-hydroxy-4-[4-(1-hydroxy-8-acetoamide-3,6-disulfo-2-naphthylazo)phenoxy]-N-[δ-(2,4-di-t-amylphenoxy)butyl]-2-naphthoamide.disodium D-1: 1-hydroxy-4-(5-phenyl-1,3,4-oxadiazolyl-2-thio)-N-[β-(3,5-dichlorosulfonyl benzamide)ethyl-2-naphthoamide C-2: 1-hydroxy-4-(β-methoxyethylamino carbonyl methoxy)-N-[δ-(2,4-di-t-amylphenoxy)butyl]-2-naphthoamide M-1: 1-(2,4,6-trichlorophenyl)-3-[3-(2,4-di-t-amylphenoxy acetoamide)benzamide]-5-pyrazolone M-2: 4,4'-methylenebis{1-(2,4,6-trichlorophenyl)-3-[3-(2,4-di-t-amylphenoxy acetoamide)benzamide]-5-pyrazolone}

CM-1: 1-(2,4-6-trichlorophenyl)-4-(1-naphthylazo)-3-(2-chloro-5-octadecenylsuccinimido anilino)-5-pyrazolone D-2: 1-(2,4,6-trichlorophenyl)-3-[3-{α-(3-pentadecylphenoxy) butylamide}-4-(1-phenyl-5-tetrazolylthio)-5-pyrazolone

Y-B:

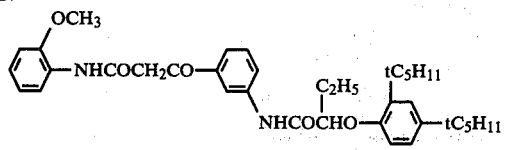

Thus, Sample-1 was prepared, and Sample-2 through Sample-5 were prepared through the process similar to that taken in Sample-1 except that the dispersed matters shown in the following Table-1 were used in place of those used in Layer-4 and Layer-8 in Sample-1 which are the green photosensitive layer and used in Layer-11 and Layer-12 which are the blue photosensitive layer therein. And, Dispersed matters (Y-2) through (Y-5), which were used in Sample-3 through Sample-5, were prepared as described below:

Dispersed matter (Y-2)

Dispersion was made similarly to the case of Dispersed matter (Y-1) except that 380 g of Illustration coupler (Y-26) were used in place of yellow coupler (Y-B) and that 190 g of TCP and 960 ml of EA were used, and thus prepared.

Dispersed Matter (Y-3)

Dispersion was made similarly to the case of Dispersed matter (Y-1) except that 400 g of Illustration coupler (Y-4) were used in place of yellow coupler (Y-B) and that 200 g of TCP and 800 ml of EA were used, and thus prepared.

Dispersed matter (Y-4)

Dispersion was made similarly to the case of Dispersed matter (Y-1) except that 387 g of Illustration coupler (Y-21) were used in place of yellow coupler (Y-B) and that 193 g of TCP and 774 ml of EA were used, and thus prepared.

Dispersed matter (Y-5)

Dispersion was made similarly to the case of Dispersed matter (Y-1) except that 425 g of Illustration coupler (Y-12) were used in place of yellow coupler (Y-B) and that 212 g of TCP and 850 ml of EA were used, and thus prepared.

The every relative reaction speed of Y-4, Y-6, Y-12 and Y-21 was more than three times faster than that of Coupler (Y-B) out of the yellow couplers relating to the invention, which was used in the present example, and which was measured in accordance with the aforesaid method for determining a relative reaction speed to set Coupler (Y-B) as the standard.

These samples were exposed respectively to white light through an optical wedge and then processed in conformity to the following processing steps:

| Processing steps (at 38° C.) | Time min. | Time sec. |
|---|---|---|
| Color developing | 3' | 15" |
| Bleaching | 6' | 30" |
| Washing | 3' | 15" |
| Fixing | 6' | 30" |
| Washing | 3' | 15" |
| Stabilizing | 1' | 30" |

The composition of the processing solution used in each of the steps is as follows:

| Composition of color developer: | | |
|---|---|---|
| 4-amino-3-methyl-Nethyl-N(β-hydroxyethyl)-aniline sulfate | 4.8 | g |
| Sodium sulfite anhydrous | 0.14 | g |
| Hydroxyamine ½ sulfate | 1.98 | g |
| Sulfuric acid | 0.74 | g |
| Potassium carbonate anhydrous | 28.85 | g |
| Potassium hydrogencarbonate anhydrous | 3.46 | g |
| Potassium sulfite anhydrous | 5.10 | g |
| Potassium bromide | 1.16 | g |
| Sodium chloride | 0.14 | g |
| Nitrilotriacetic acid 3 sodium salt (monohydrate) | 1.20 | g |
| Potassium hydroxide | 1.48 | g |
| Add water to make | 1 | litr. |
| **Composition of Bleaching Bath:** | | |
| Ethylenediamine tetraacetic acid ferric ammonium salt | 100.0 | g |
| Ethylenediaminetetraacetic acid 2 ammonium salt | 10.0 | g |
| Ammonium bromide | 150.0 | g |
| Glacial acetic acid | 10.0 | ml |
| Add water to make | 1 | ltr. |
| Adjust pH value by making use of ammonia water to | 6.0 | |
| **Composition of Fixer:** | | |
| Ammonium thiosulfate | 175.0 | g |
| Sodium sulfite anhydrous | 8.6 | g |
| Sodium metasulfite | 2.3 | g |
| Add water to make | 1 | ltr. |
| Adjust pH value by making use of acetic acid to | 6.0 | |
| **Composition of Stabilizer:** | | |
| Formalin (37% solution) | 1.5 | ml |
| Koniducks (mfd. by Konishiroku Photo Ind. Co., Ltd.) | 7.5 | ml |
| Add water to make | 1 | ltr. |

Next, on the color image formed on each of the above-mentioned samples, the sensitivity, gamma, graininess and developing stability thereof were measured.

The results obtained therefrom are shown in Table-1.

Wherein, the relative sensitivity, gamma and graininess of each unit layer forming a color image are expressed in the values measured when exposed to white light, and the relative sensitivity is a value relative to the value of sensitivity of the green photosensitive layer of Sample-1 exposed to white light which is taken the value of 100, and the graininess (RMS) expresses a value multiplied thousand times of the standard deviation of a density fluctuation caused when a scanning was made by means of a micron-densitometer having a circular scanning aperture is 2.5μ.

Developing stability expresses a value measured the ratio of a gamma value under the above-mentioned development conditions (γo) to a gamma value for the thirty seconds shorter period of time than the former (i.e., two minutes forty five seconds), that is, $\gamma s/\gamma o \times 100(\%)$. The closer this ratio approaches to 100%, the better the developing stability will display.

TABLE 1

| Sample No. | Green photosensitive layer Dispersed matter | Layer-4 Layer-8 Coupler | Blue photosensitive layer Layer-11 Layer-12 Dispersed matter | Characteristics of green photosensitive layer: Relative sensitivity | Gamma | Graininess (RMS) | Developing stability (%) |
|---|---|---|---|---|---|---|---|
| 1 Other than Invention | M-1 | M-1 M-2 CM-1 | Y-1 | 100 | 0.57 | 70 | 85 |
| 2 This Invention | Y-2 | Y-26 (100 mol %) | M-1 | 105 | 0.58 | 41 | 95 |
| 3 | Y-3 | Y-4 (100 mol %) | M-1 | 98 | 0.56 | 39 | 96 |
| 4 | Y-4 | Y-21 (100 mol %) | M-1 | 110 | 0.58 | 39 | 97 |
| 5 | Y-5 | Y-12 (100 mol %) | M-1 | 110 | 0.57 | 41 | 95 |

As is obvious from Table-1, in comparison with the graininess and developing stability of the green photosensitive layer of a conventional type of the negative-positive system (i.e., Sample-1), there has been observed the distinguished graininess and the improved effects in the developing stability in the novel color photosensitive materials of the invention, the sensitivity and the gamma thereof are none the less almost equal. Although nothing is mentioned in Table-1, the sensitivity of the red photosensitive layers were also improved more than ever. These are not predictable from the conventional technological thoughts and exhibit the amazing effects.

EXAMPLE 2

Sample-6 through Sample-11 were prepared through the process similar to that taken in Sample-1 except that the dispersed matters as shown in the following Table-2 replaced the dispersed matters of Layer-4 and Layer-8 which are the green photosensitive layers and of Layer-11 and Layer-12 which are the blue photosensitive layer of Sample-1 in the aforegoing Example-1. Details of the samples are shown in Table-2.

Dispersed matter (Y-6) through Dispersed matter (Y-11) were prepared as follows:

Dispersed matter (Y-6)

Dispersion was made similarly to the case of Dispersed matter (Y-1) in the aforegoing Example-1 except that 60 g of yellow couplers (Y-B) and 340 g of the illustration coupler (Y-12) and also 200 g of TCP and 800 ml of EA were used, and thus prepared.

Dispersed matter (Y-7)

Dispersion was made similarly to the case of Dispersed matter (Y-1) in the aforegoing Example-1 except that 118 g of yellow couplers (Y-B) and 254 g of the illustration coupler (Y-12) and also 186 g of TCP and 745 ml of EA were used, and thus prepared.

Dispersed matter (Y-8)

Dispersion was made similarly to the case of Dispersed matter (Y-1) in the aforegoing Example-1 except that 180 g of yellow couplers (Y-B) and 170 g of the illustration coupler (Y-12) and also 161 g of TCP and 644 ml of EA were used, and thus prepared.

Dispersed matter (Y-9)

Dispersion was made similarly to the case of Dispersed matter (Y-1) in the aforegoing Example-1 except that 237 g of yellow couplers (Y-B) and 85 g of the illustration coupler (Y-12) and also 161 g of TCP and 644 ml of EA were used, and thus prepared.

Dispersed matter (Y-10)

Dispersion was made similarly to the case of Dispersed matter (Y-1) in the aforegoing Example-1 except that 251 g of yellow couplers (Y-B) and 64 g of the illustration coupler (Y-12) and also 158 g of TCP and 630 ml of EA were used, and thus prepared.

Dispersed matter (Y-11)

Dispersion was made similarly to the case of Dispersed matter (Y-1) in the aforegoing Example-1 except that 266 g of yellow couplers (Y-B) and 43 g of the illustration coupler (Y-12) and also 154 g of TCP and 617 ml of EA were used, and thus prepared.

The sensitivity, gamma, graininess and developing stability of each of these samples was measured in the same evaluation methods as described in the aforegoing Example-1, and the results thereof are shown in Table-2.

(Proviso: Sample-1 and Sample-5 are the same as the ones described in Example-1)

TABLE 2

| Sample No. | Green photosensitive layer Dispersed matter | Layer-4 Layer-8 Coupler | Blue photosensitive layer Layer-11 Layer-12 Dispersed matter | Characteristics of green photosensitive layer: Relative sensitivity | Gamma | Graininess (RMS) | Developing stability (%) |
|---|---|---|---|---|---|---|---|
| 1 Other than Invention | M-1 | M-1 M-2 CM-1 | Y-1 | 100 | 0.57 | 70 | 85 |
| 5 This Invention | Y-5 | Y-12 (100 mol %) | M-1 | 110 | 0.57 | 41 | 95 |
| 6 | Y-6 | Y-B (20 mol %) Y-12 (80 mol %) | M-1 | 102 | 0.56 | 41 | 97 |
| 7 | Y-7 | Y-B (40 mol %) Y-12 (60 mol %) | M-1 | 100 | 0.57 | 39 | 96 |

TABLE 2-continued

| Sample No. | Green photo-sensitive layer Dispersed matter | Layer-4 Layer-8 Coupler | Blue photo-sensitive layer Layer-11 Layer-12 Dispersed matter | Characteristics of green photosensitive layer: Relative sensitivity | Gamma | Graininess (RMS) | Developing stability (%) |
|---|---|---|---|---|---|---|---|
| 8 | Y-8 | Y-B (60 mol %) Y-12 (40 mol %) | M-1 | 107 | 0.55 | 40 | 95 |
| 9 | Y-9 | Y-B (80 mol %) Y-12 (20 mol %) | M-1 | 98 | 0.57 | 38 | 95 |
| 10 | Y-10 | Y-B (85 mol %) Y-12 (15 mol %) | M-1 | 105 | 0.57 | 40 | 87 |
| 11 | Y-11 | Y-B (90 mol %) Y-12 (10 mol %) | M-1 | 105 | 0.57 | 40 | 88 |

As is obvious from the results shown in Table-2, the impprovement effects on the graininess and the developing stability of the green photosensitive layer relating to the invention being illustrated in Example-1 are not lowered even if yellow couplers are jointly used. In particular, when more than 20 mol% of high speed reactive couplers are used to serve as yellow couplers, the improvement effects on the developing stability are remarkable.

What is claimed is:

1. A silver halide color photosensitive material for taking a photograph comprising a red photosensitive silver halide emulsion layer, a green photosensitive silver halide emulsion layer and blue photosensitive silver halide emulsion layer and each of which comprises a coupler out of every three kinds of the couplers, namely, anti-diffusive yellow, magenta and cyan couplers, and in which said green photosensitive silver halide emulsion layer is composed of at least two layers and between those of which said red photosensitive silver halide emulsion layer is arranged, and said green photosensitive silver halide emulsion layer comprises an anti-diffusive yellow coupler.

2. A silver halide color photosensitive material according to claim 1, wherein the red photosensitive silver halide emulsion layer comprises a cyan coupler and the blue photosensitive silver halide emulsion layer comprises a magenta coupler.

3. A silver halide color photosensitive material according to claim 1, wherein the anti-diffusive yellow coupler is one of high speed reactive yellow couplers.

4. A silver halide color photosensitive material according to claim 1, wherein the anti-diffusive yellow coupler is represented by the general formula (I)

General Formula [I]

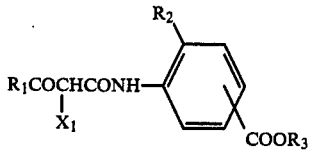

wherein, $R_1$ represents a tertiary butyl group or an aryl group, $R_2$ represents a hydrogen atom, a halogen atom or an alkoxy group, $R_3$ represents an alkyl group, an alkenyl group, an aralkyl group, a cycloalkyl group, an aryl group or a heterocyclic residual group, and $X_1$ represents a cyclic diacylamino group, a cyclic monoacylamino group or a triazole ring residual group in which a nitrogen atom couples directly to a carbon atom at the active site in the formula.

5. A silver halide color photosensitive material according to claim 1, wherein the anti-diffusive yellow coupler is represented by the general formula (II)

General Formula [II]

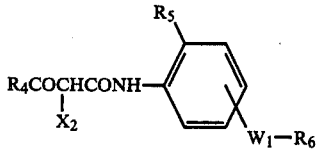

wherein, $R_4$ and $R_5$ represent the groups represented by $R_1$ and $R_2$ in the aforegoing general formula [I], respectively, $W_1$ represents $—SO_2—$ group, $—SO_2NH—$ group or $—NHSO_2—$ group, $R_6$ represents alkyl group, aryl group or heterocyclic residual group, and $X_2$ represents a cyclic diacylamino group, a cyclic monoacylamino group, a triazole ring residual group in which a nitrogen atom couples directly to a carbon atom at the active site in the formula, an aryloxy group, an acyloxy group or an arylthio group.

6. A silver halide color photosensitive material according to claim 1, wherein the anti-diffusive yellow coupler is represented by the general formula (III)

General Formula [III]

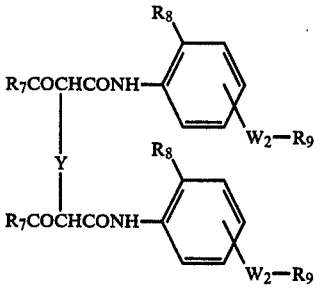

wherein, $R_7$ and $R_8$ represent respectively the groups represented by $R_1$ and $R_2$ in the foregoing general formula [I], $W_2$ represents

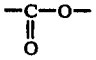

group (provided that a carbon atom couples directly to a benzene ring), $—NHSO_2—$ group or $—SO_2NH—$ group, $R_9$ represents alkyl group, aryl group or heterocyclic residual group, and Y represents a bivalent organic group formulated in the formulae

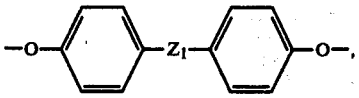
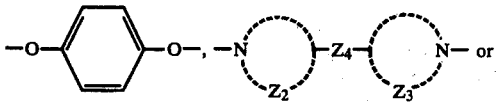
-continued
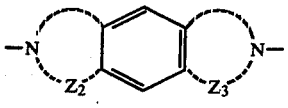
wherein, $Z_1$ represents sulfonyl group, carbonyl group or alkylenedisulfonamide group; $Z_2$ and $Z_3$ represent the atomic groups of nonmetals necessary for forming 4–6 membered hetero ring together with a nitrogen atom; and $Z_4$ represents a simple coupling hand or a bivalent organic group.
* * * * *